United States Patent [19]

Watanabe et al.

[11] 4,024,811

[45] May 24, 1977

[54] HIGH SPEED PRINTING APPARATUS

[75] Inventors: Akinori Watanabe; Katsuhide Tanoshima; Matsusaburo Noguchi, all of Tokyo, Japan

[73] Assignee: Oki Electric Industry Company, Ltd., Tokyo, Japan

[22] Filed: June 2, 1976

[21] Appl. No.: 691,996

Related U.S. Application Data

[63] Continuation of Ser. No. 531,762, Dec. 11, 1974, abandoned.

[30] Foreign Application Priority Data

Dec. 20, 1973 Japan ..... 48-141816

[52] U.S. Cl. ..... 101/1; 101/DIG. 13

[51] Int. Cl.[2] ..... G03G 13/06

[58] Field of Search ..... 101/DIG. 13, 366; 346/75, 74, 140 R

[56] References Cited

UNITED STATES PATENTS

| | | | |
|---|---|---|---|
| 3,370,529 | 2/1968 | Michalchik | 101/1 |
| 3,521,558 | 7/1970 | Fisher et al. | 101/114 |
| 3,779,166 | 12/1973 | Pressman et al. | 101/426 |
| 3,967,549 | 7/1976 | Thompson et al. | 101/DIG. 13 |

FOREIGN PATENTS OR APPLICATIONS

| | | | |
|---|---|---|---|
| 719,239 | 12/1954 | United Kingdom | 101/DIG. 13 |

*Primary Examiner*—J. Reed Fisher
*Attorney, Agent, or Firm*—Peter L. Berger

[57] ABSTRACT

A high speed printing apparatus in which ions produced between electrodes receiving a high voltage are passed through an ink mist so that they are deposited with the ink particles to perform printing with such ion-loaded ink, characterized in that the ink mist produced in a mist tank is once stored in a reservoir tank and then fed to the printing section.

4 Claims, 7 Drawing Figures

HIGH SPEED PRINTING APPARATUS

This is a continuation of application Ser. No. 531,762, now abandoned, filed Dec. 11, 1974.

BACKGROUND OF THE INVENTION

With the increase of operating speed of central processor units in the electronic computer system, further speed-up of the high-speed printing apparatus, which is an output unit, has been required and various improvements have been made.

A typical example of such improvements is a system in which ink is supplied to the nozzle under a very low pressure, such that the ink will assume a hemispherically projecting state at the nozzle end and an electric field is applied between the nozzle and an accelerating electrode positioned several millimeters in front of the nozzle to draw out the ink in the form of droplets, and then a strong electric field is provided between the nozzle and the platen to let the ink droplets move toward the surface of the printing sheet, so that said ink droplets are electrostatically deflected in both main and auxiliary directions (right and left) to thereby print letters, signs or such on the surface of the printing sheet.

There is also known a system in which the ions produced between the electrodes which receive a high voltage are passed through the ink mist so that they are deposited with the ink particles, and such ion-carrying ink particles are adsorbed on the surface of the printing sheet.

The present invention concerns a further improvement in the latter system, so this system is first described in further detail for a better understanding of the present invention.

Referring to FIG. 1, when a high voltage on the order of several thousand volts is applied between the anode 101 formed from a wire electrode and the cathode 103 in the platen 102, cations are produced from said anode 101. These cations tend to migrate toward the cathode by passing the aperture 104*a* in each aperture board 104, but such migration is retarded or promoted depending on the potential of the selective electrode 104*b*. That is, an ion controlling electrode comprising a common electrode 104*c* arranged to always maintain a constant voltage relative to said selective electrode 104*b* and a insulating member 104*d* interposed between said two electrodes is formed centering around the aperture 104*a*, and the selective electrode 104*b* is connected to a drive circuit (not shown), so that it is selectively driven to a positive or negative potential relative to the constant potential of the common electrode 104*c*. Therefore, if the potential of the selective electrode 104*b* is higher than that of the common electrode 104*c*, the electric field in the aperture 104*a* is orientated in the direction of the cathode and hence the cations can pass through said aperture 104*a*, but if the potential of the selective electrode 104*b* is lower than that of the common electrode 104*c*, the electric field in the aperture 104*a* is directed in the opposite direction and hence passage of the cations is prevented. Thus, in order to obtain a desired printing pattern, all the selective electrodes 104*b* are driven to control said movement of the cations for all of the aperture 104*a*. The cations which have passed the aperture 104*a* enter the ink mist 105, and while passing through this ink mist, they are deposited with fine ink particles and further continue their movement toward the cathode 103 until they are adsorbed on the surface of a printing sheet 106. Thus, dots are printed on the printing sheet 106 by the ink particles carried on the cations. This is effectuated throughout the entire width of the printing sheet 106, and hence the letters (figures, etc.) formed from plural dot patterns are printed all together in lines, with the above-said operation being programmed as main scanning and feed of the printing sheet 106 as auxiliary scanning.

The ink mist 105 is produced from the ink solution 108 in a mist tank 107 when vibrators 109 made of a piezoelectric material are vibrated by a high-frequency electric pulse, and such ink mist is supplied to the printing section. There exist air streams on both upper and lower sides of said ink mist 105. These air streams serve to prevent the printing sheet 106 and aperture board 104 from being soiled by said ink mist 105. For this reason, the ink mist 105 flows in the form of a strip as shown in the drawing. The circulation system of these ink mist and air streams consists of a separator 110 adapted for collecting the ink particles alone from the mixture of the ink particles and air, a cooler 111 for cooling air, a main pump 112 for feeding air into the mist tank 107 and printing section, and air pipes connecting said means.

FIG. 2 is a perspective view of the printing section in the above-described type of high-speed printing apparatus, and FIG. 3 is a top plane view of an aperture board 104. In the surface of said aperture board 104 are formed a plurality of apertures 104*a* arranged in staggered relation to each other and along the length of the aperture board 104 as shown, and an ion controlling electrode is provided for each of said apertures 104*a*.

One of the serious problems encountered in the above-described type of high-speed printing apparatus is that the ink mist density must be maintained uniform throughout the full width of the printing sheet. FIG. 4 shows a horizontal section of the mist tank 107 horizontally cut along the central portion thereof. The lateral length of this tank corresponds to the width of the printing sheet, and a plurality of vibrators 109 are provided at a given interval at the bottom of the tank. If even one of these vibrators should be damaged, the ink mist density at the printing position corresponding to the damaged vibrator is reduced and consequently the printed letters are blurred.

OBJECTS OF THE INVENTION

One object of the present invention is to provide an improved high-speed printing mechanism in which the ink mist produced in the mist tank is once stored in a reservoir tank wherein to mix up the mist into a uniform density, and then such uniformly mixed ink mist is fed in between the aperture and the printing sheet so that the letters can be printed always with uniform density over the entire span of the printing sheet.

Another object of the present invention is to provide a mechanism of the type described in which a reservoir or buffer tank is provided, so that the ink mist source such as the mist tank can be located at a place distant from the printing position.

Still another object of the present invention is to provide a printing mechanism of the cited type in which a reservoir or buffer tank is provided so that the mist tank may not necessarily be conformed in its size and shape to the printing sheet but may be reduced in size and shape in any desired configuration.

SUMMARY OF THE INVENTION

The present invention relates to an improved high-speed printing apparatus in which the ink mist produced in an ink mist source such as a mist tank is first stored in a reservoir tank and then supplied to the printing station.

DETAILED DESCRIPTION OF THE INVENTION

Figure 1:
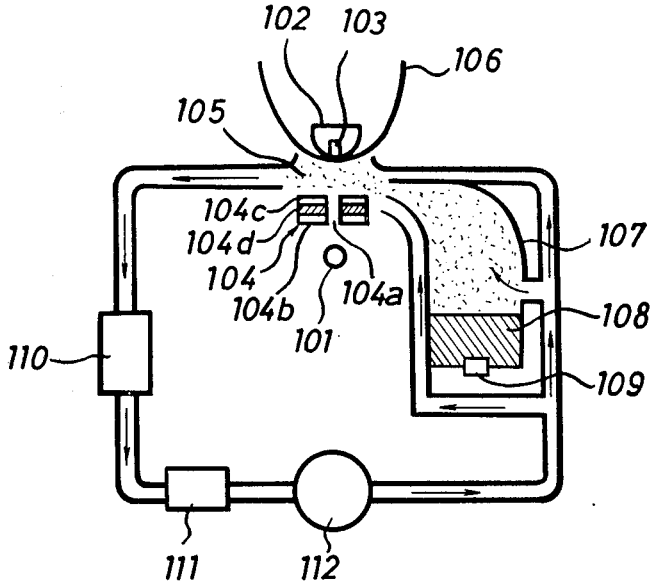
FIG. 1 is a schematic block diagram for illustrating the printing principle in a prior art high-speed printing apparatus.
Figure 2:
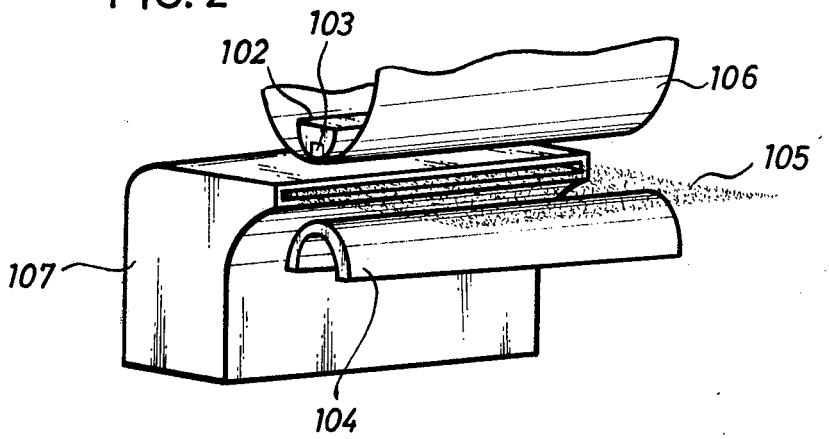
FIG. 2 is a schematic perspective view of the printing section of said printing apparatus.
Figure 3:
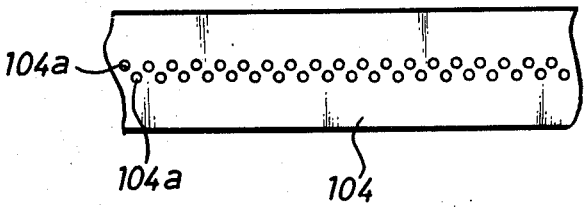
FIG. 3 is a plane view of an aperture.
Figure 4:
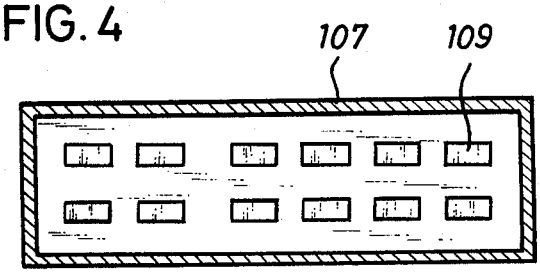
FIG. 4 is a sectional plane view of a mist tank.
Figure 5:
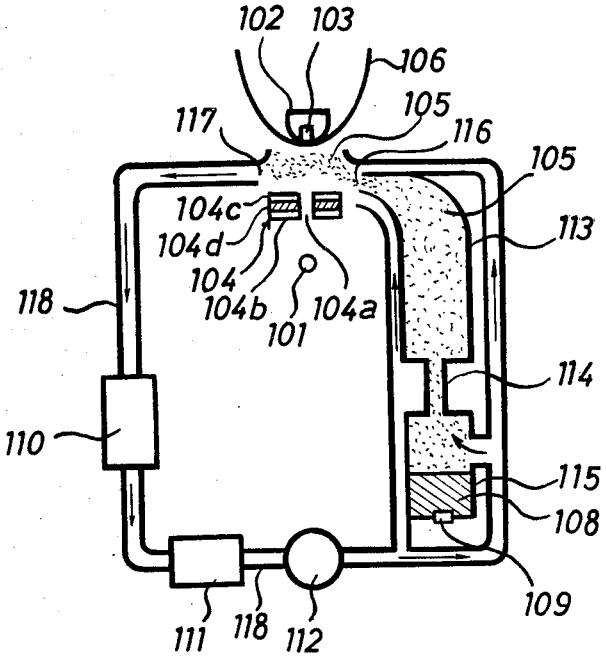
FIG. 5 is a schematic block diagram of a high-speed printing apparatus according to the present invention.
Figure 6:
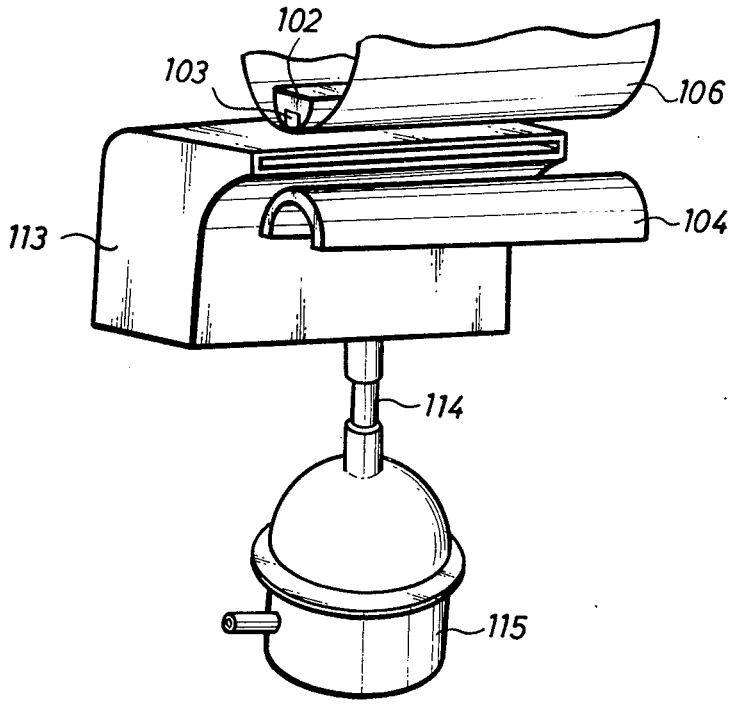
FIG. 6 is a diagonal view showing the connected condition of the reservoir tank and mist tank.
Figure 7:
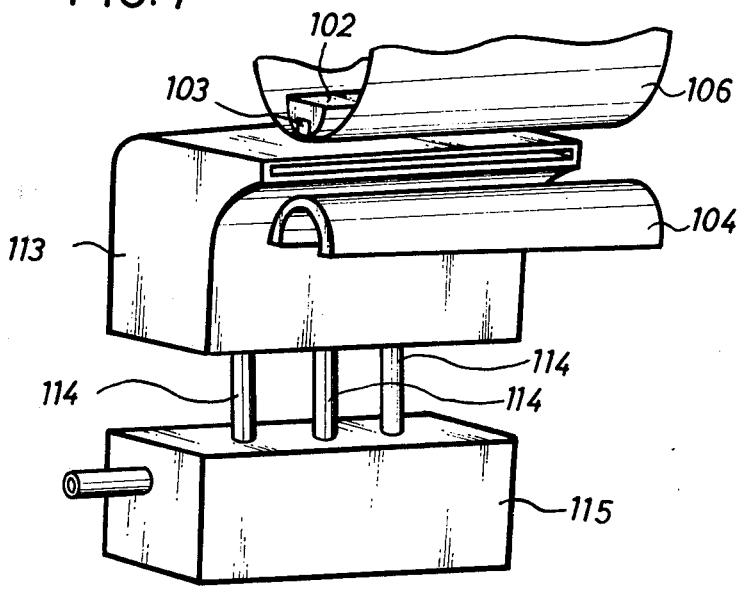
FIG. 7 is a diagonal view showing the connected condition of the reservoir tank and mist tank.

Referring to FIG. 5, it will be seen that an aperture board 104 is provided between the anode 101 and the cathode 103 in the platen 102. Said aperture board 104 has a selective electrode **104*b* on its anode side and a common electrode 104*c* on its cathode side, with an insulting member 104*d* being interposed between said both electrodes. In the surface of said apertures are provided a plurality of aperture 104*a* arranged in staggered relation continuously along the length of the aperture board, with an ion controlling electrode being provided for each of said apertures 104*a*. The selective electrode 104*b* is connected to a drive circuit (not shown) so that it is selectively driven to a positive or negative potential relative to the potential of the common electrode 104*c*** which is always maintained at a constant potential.

Between said aperture board 104 and platen 102 is provided a means for feeding the ink mist 105. This ink mist is produced from the ink solution 108 in a mist tank 115 by the vibrators 109 made of a piezo-electric material and arranged to be given a high frequency electric pulse to generate vibration to thereby form an ink mist from the ink solution 108. The thus formed ink mist 105 is guided through an conduit pipe 114 into a reservoir or buffer tank 113 having an opening 110 which conforms to the width of the printing sheet 106 and which is directed toward the space between the aperture board 104 and the platen 102 (hence printing sheet 106). Present on both upper and lower sides of said ink mist 105 are air streams which flow in the same direction as the ink mist stream and which serve to prevent the printing sheet 106 and aperture board 104 from being soiled by the ink mist 105.

Provided in opposition to said opening 116 is an ink mist and air collecting port 117 which is connected to a separator 110 through a pipe 118 and thence further connected to a cooler 111 and a main pump 112 also through a pipe 118.

In operation of this printing press, in order to obtain a desired printing pattern, each of the selective electrodes **104*b* is driven to control the movement of the cations for all of the aperture 104*a*, and the cations which have passed the aperture 104*a* enter the ink mist 105 and are deposited with the fine ink particles. The cations thus loaded with the fine ink particles further continue their movement toward the cathode 103 and are adsorbed on the surface of the printing sheet 106, thus effecting dot printing. This is effectuated simultaneously over the full width of the printing sheet 106, and the letters formed from plural dot patterns are printed all together in lines, with the above-said operation being practiced as main scanning and the feed of the printing sheet 106** as auxiliary scanning.

Thus, the ink mist 105 which is to be fed in between the printing sheet 106 and the aperture board 104 is produced by the vibrators 109 in the mist tank 107, then once guided into the buffer or reservoir tank 113 through a conduit pipe 114 and mixed up therein into a uniform concentration, and then discharged out from the opening 116. A part of the thus discharged ink mist is put to use for dot printing while the remaining ink mist and air streams are collected in the collecting port 117 and guided into the separator 110 where the ink particles are separated from air, the latter being then guided into the cooler 111 for cooling therein and thence into the main pump 112 whereby air is again partly charged into the mist tank 115 while the remaining part is used for air streams.

According to the present invention, as described above, an ink mist reservoir tank is provided in connection to the mist tank so that the ink mist is adjusted into a uniform density in said tank and then discharged, so that even if one of the vibrators should break down, no partial disparity of ink mist density takes place, allowing printing of letters of always constant density.

Provision of such reservoir or buffer storage tank also makes it possible to set the ink mist source such as mist tank at a location distant from the printing position. This greatly increases the versatility of the machine setting conditions. Further, owing to provision of said reservoir tank, it becomes unnecessary to conform the size and shape of the mist tank to the width of the printing sheet used, and it becomes possible to freely change the lateral length of the mist tank, allowing reduction of the size of the tank.

What is claimed is:

1. A high speed printing apparatus comprising a printing sheet, electrodes disposed proximate to said sheet, a high electrical voltage being applied to said electrodes, charged ions passing between said electrodes and said printing sheet and toward said printing sheet, the rate at which said ions pass toward said printing sheet being controlled by the high electrical voltage applied to said electrodes, means for forming an ink mist and passing said ink mist through an aperture located proximate to said electrodes and toward said printing sheet, said ions passing through said ink mist to be deposited with ink particles of said ink mist onto said printing sheet for printing symbols, said means for forming said ink mist comprising an ink tank containing said ink, a plurality of resonators resonating within said ink tank, the improvement comprising a buffer storage means for storing said ink mist and pipe means connected between said ink tank and said buffer storage means, said pipe means comprising a cross-sectional area narrower than the cross-section areas of each of said ink tank and buffer storage means, said pipe means separating the process of forming the ink mist in said ink tank from said buffer storage means and said aperture to the effect of individual resonator elements of the ink mist passing toward said printing sheet.

2. A high speed printing apparatus as set forth in claim 1, wherein said pipe means comprises three separate spaced apart pipes.

3. A high speed printing apparatus as set forth in claim 2, wherein said aperture has a width substantially equal to the width of said printing sheet.

4. A high speed printing apparatus as set forth in claim 1, wherein said mist tank for producing said ink mist is remotely located from the region where printing occurs.

* * * * *